US007351089B2

(12) United States Patent
Neale, III

(10) Patent No.: US 7,351,089 B2
(45) Date of Patent: Apr. 1, 2008

(54) ELECTRICAL CONNECTOR HAVING A CPA PLUG

(75) Inventor: Frank T. Neale, III, Roaming Shores, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/796,083

(22) Filed: Apr. 26, 2007

(65) Prior Publication Data

US 2007/0254518 A1 Nov. 1, 2007

Related U.S. Application Data

(60) Provisional application No. 60/796,015, filed on Apr. 28, 2006.

(51) Int. Cl.
*H01R 13/627* (2006.01)

(52) U.S. Cl. ..... 439/352; 439/489

(58) Field of Classification Search ..... 439/352, 439/489, 357

See application file for complete search history.

(56) References Cited

U.S. PATENT DOCUMENTS

| | | | | |
|---|---|---|---|---|
| 6,217,388 | B1 | 4/2001 | Francis | |
| 6,287,139 | B1 * | 9/2001 | Seko et al. | 439/489 |
| 6,439,914 | B2 * | 8/2002 | Nimura | 439/352 |
| 6,705,886 | B1 * | 3/2004 | Brown | 439/489 |
| 2004/0157486 | A1 * | 8/2004 | Brown | 439/489 |

* cited by examiner

*Primary Examiner*—Tho D. Ta
(74) *Attorney, Agent, or Firm*—David P. Wood

(57) ABSTRACT

An electrical connector has a CPA plug (connector position assurance plug) for assuring that the electrical connector is properly connected to a mating electrical connector. The electrical connector includes a right-angled connector body having a plurality of longitudinal channels that open into an axial shroud that plugs into a socket of the mating connector in the axial direction, and a plurality of right angled terminals that are disposed in the plurality of longitudinal channels respectively with their respective contacts disposed in the axial shroud. The axial shroud has a cover at one end and the CPA plug is attached to the cover for movement between a prestaged position and a final locked position assuring that the electrical connector is properly connected to the mating electrical connector. Three embodiments are disclosed.

13 Claims, 9 Drawing Sheets

ELECTRICAL CONNECTOR HAVING A CPA PLUG

REFERENCE TO RELATED APPLICATIONS

This application claims the benefit of U.S. Provisional Application No. 60/796,015 filed Apr. 28, 2006.

BACKGROUND OF THE INVENTION

This invention relates to an electrical connector having a CPA plug (formally known as a connector position assurance plug). Electrical connectors having a CPA plug that is attached to a connector body by a strap are already known. In this arrangement, the CPA plug is plugged into the connector body after the electrical connector is attached to a mating connector to assure that the electrical connector is properly connected to the mating connector. A draw back of this type of arrangement is that it requires a two-step operation. First the CPA plug is aligned with a receiving portion of the connector body and inserted into the connector body a small distance to an initial or starting position which may be difficult, particularly in a blind assembly situation. Then the CPA plug is pushed into the connector body to a final locked position which assures that the two electrical connectors are properly mated.

SUMMARY OF THE INVENTION

This invention provides an electrical connector wherein the CPA plug is already attached to the connector body in a prestaged position from which the CPA plug can be pushed to a final locked position assuring that the electrical connector is properly connected to the mating electrical connector. This arrangement avoids the often difficult and time consuming task of aligning the CPA plug with the receiving portion of the connector body for an initial plug in. The CPA plug of the invention is already in a prestaged position in the connector body (116) so that the CPA plug is simply pushed to its final locked position assuring that the two electrical connectors are properly mated.

DETAILED DESCRIPTION OF THE PREFERRED EMBODIMENTS

Figure 1:
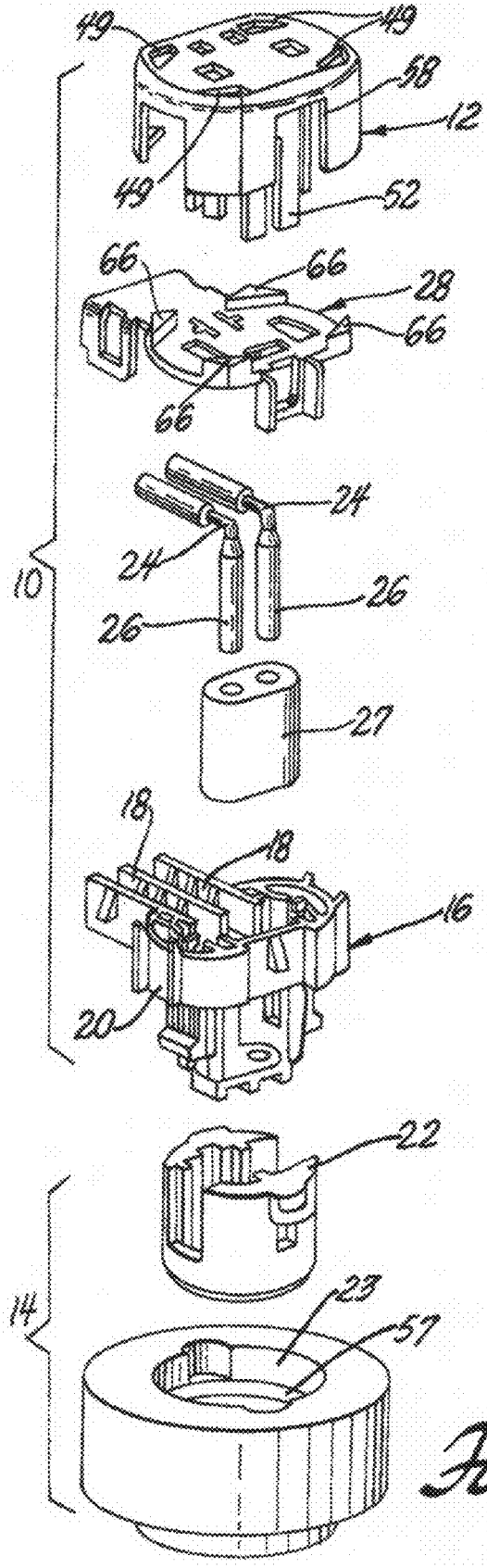
FIG. 1 is an exploded isometric view of an electrical connector illustrating a first embodiment of the invention.

Referring now to FIGS. 1 to 6, an electrical connector (10) illustrating a first embodiment of the invention has a CPA plug (12) (connector position assurance plug) for assuring that the electrical connector (10) is properly connected to a mating electrical connector (14). Electrical connector (10) comprises a right-angled connector body (16) having a plurality of longitudinal channels (18) that open into an axial shroud (20) that plugs part way into an insert (22) disposed in a socket (23) of the mating connector (14) in the axial direction. A plurality of right angled terminals (24) are disposed in the plurality of longitudinal channels respectively with their respective socket contacts (26) disposed in an optional filter (27) that is disposed in the axial shroud (20). A cover (28) is attached to the connector body (16) so that it overlies the connector body (16) covering the plurality of longitudinal channels (18) and closing the axial shroud (20) at one end.

The CPA plug (12) is attached to the cover (28) for movement between an initial prestaged position (shown in FIGS. 2, 3 and 4) and a final locked position (shown in FIGS. 7 and 8) assuring that the electrical connector (10) is properly connected to the mating electrical connector (14) when the electrical connectors (10) and (14) are mated.

The CPA plug (12) has an operator pad (30) outwardly of the cover (28), a skirt (31) and a plurality of spaced legs (32) inside the skirt (31) that project into the axial shroud (20) via slots that extend through cover (28).

Figure 4:
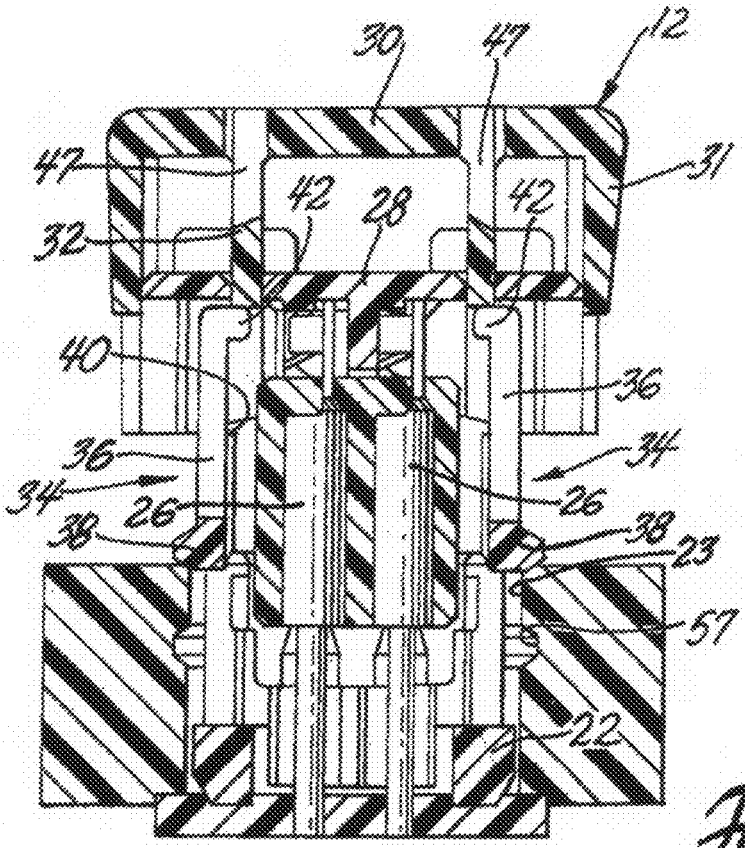
FIG. 4 is a vertical section of the electrical connector shown in FIG. 2.
Figure 5:
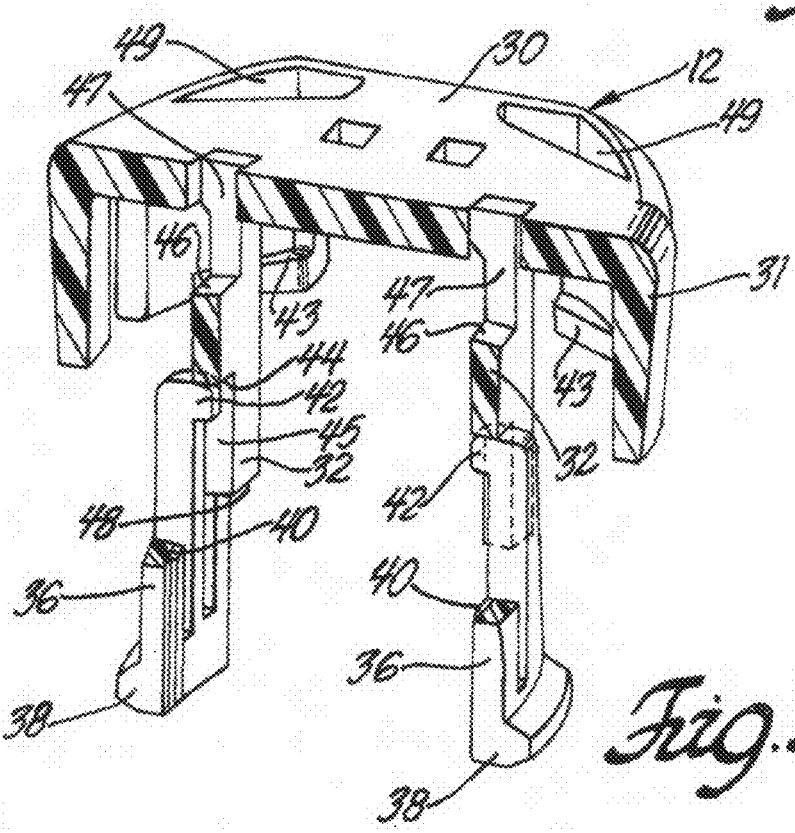
FIG. 5 is a vertical slice taken through components of the electrical connector shown in FIG. 2.

The axial shroud (20) has a plurality of lock mechanisms (34) for holding the CPA plug (12) in the initial prestaged position or in the final locked position. As best shown in FIGS. 4 and 5, each lock mechanism (34) comprises a pivotal lock arm (36) that is pivotally connected to the axial shroud (20) by a resilient portion. The pivotal lock arm (36) has a lower outwardly projecting lock ridge (38) for locking the electrical connector (10) to the mating electrical connector (14), a medial inwardly projecting push ledge (40) for mating the electrical connectors (10) and (14), and an upper inwardly projecting lock nib (42) that is engageable with one of the plurality of legs of the CPA plug for holding the CPA in either its initial or its final position.

Figure 3:
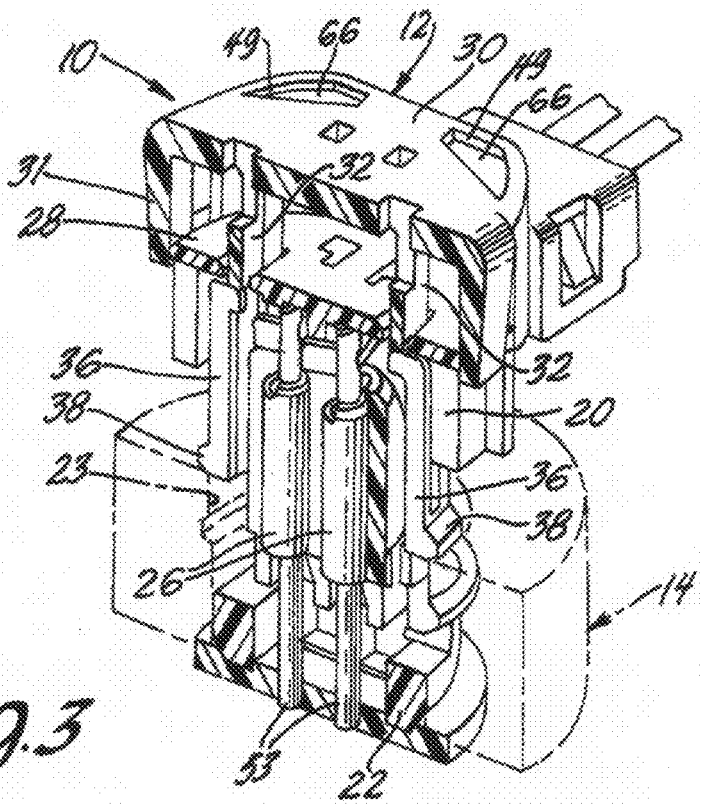
FIG. 3 is a vertical slice taken through the perspective view of the electrical connector shown in FIG. 2.

Each leg (32) of the CPA plug (12) has a first portion (44) engaged by the lock nib (42) of each lock mechanism (34) to hold the CPA plug (12) up in the pre-staged position as best shown in FIGS. 3, 4 and 5. The first portion (44) engaged by the lock nib (42) of each lock mechanism (34) to hold the CPA plug in the prestaged position is illustrated as a lower bottomless window (45) in leg (32) while the lock nib (42) is illustrated by a single lock nib. The CPA plug (12) is retained, that is, held down, in the pre-staged position by four ledges (43) at the bottom of skirt (31) that are aligned with triangular corner openings (49) in operator pad (30) and that engage the bottom of cover (28).

Figure 7:
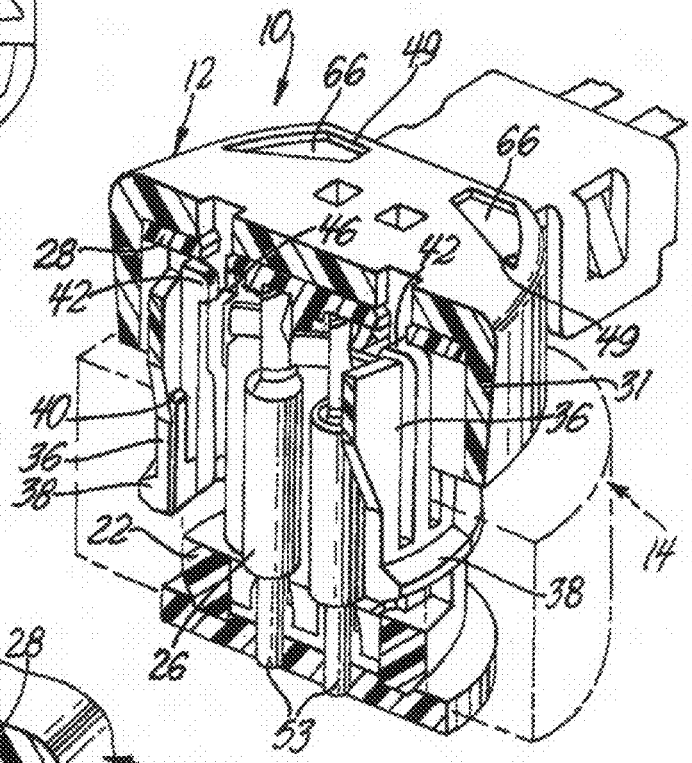
FIG. 7 is vertical slice taken through a perspective view of the electrical connector of FIG. 2 when the electrical connector is properly connected.
Figure 8:
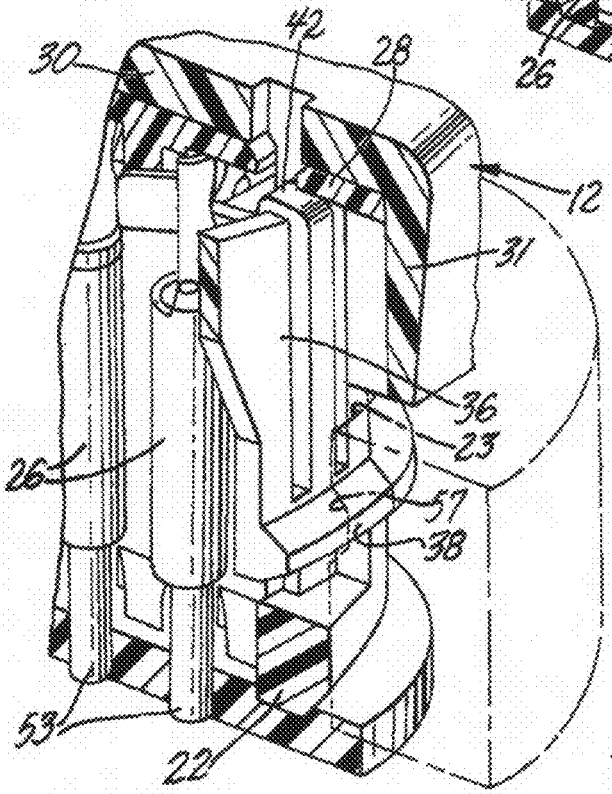
FIG. 8 is an enlarged portion of FIG. 7.

Each leg (32) of the CPA plug (12) also has a third portion (46) engaged by the lock nib (42) of each lock mechanism (34) to hold the CPA plug (12) in the final locked position when the electrical connector is properly connected to the mating electrical connector (14) as shown in FIGS. 7 and 8. The third portion (46) engaged by the lock nib (42) of the one lock mechanism to hold the CPA plug in the final locked position when the electrical connector (10) is properly connected to the mating electrical connector (14) is illustrated as the bottom of an upper window (47) in leg (32) as best shown in FIG. 5.

Figure 6:
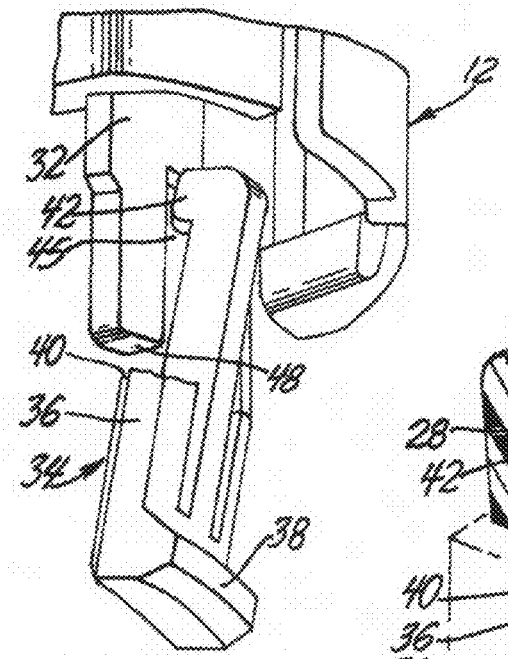
FIG. 6 is an enlarged partial perspective of the electrical connector shown in FIG. 2.

Each leg (32) of the CPA plug (12) also has a third portion (48) that engages the push ledge (40) for pushing the electrical connector (10) into locked engagement with the mating electrical connector (14). The third portion (48) that engages the push ledge (40) for pushing the electrical connector into locked engagement with the mating electrical connector (14) is illustrated as the bottom surfaces (48) of leg (32) on either side of the bottomless window (45) as best shown in FIGS. 5 and 6.

Figure 2:
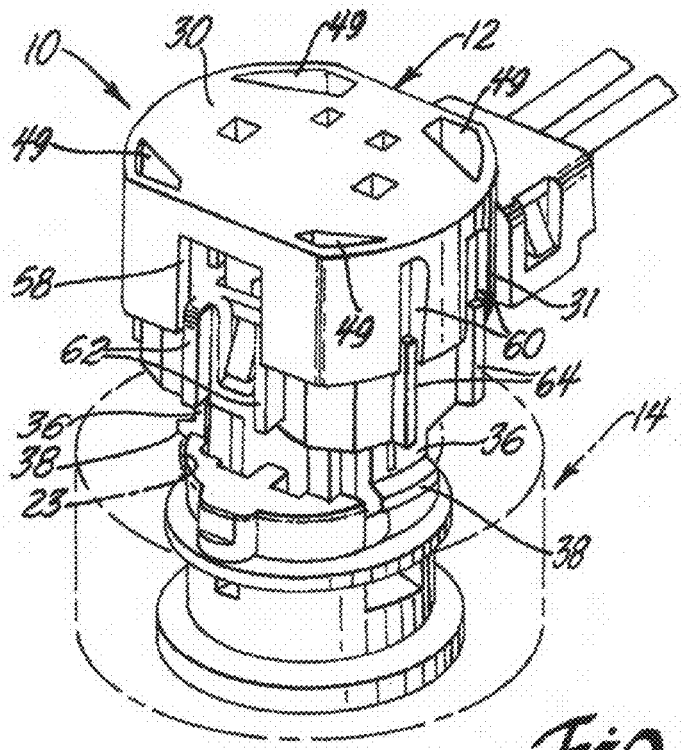
FIG. 2 is a perspective view of the electrical connector of FIG. 1 in the process of being connected.

As indicated above, electrical connector (10) may also include a filter (27) isolating terminal contacts (26) from each other inside shroud (20). CPA plug (12) preferably includes a depending guide (52) that extends through a slot in cover (28) and into shroud (20) where it engages an internal guide rail (not shown) of shroud (20) to guide CPA plug (12) when it is pushed to the final locked position shown in FIGS. 7 and 8. As best shown in FIG. 2, CPA plug (12) also preferably includes a front guide slot (58) and side guide slots (60) in skirt (31) that cooperate with guide rails (62) of cover (28) and guide rails (64) of shroud (20) respectively to guide CPA plug (12) when it is pushed down to the final locked position shown in FIGS. 7 and 8.

While a bifurcated guide (52) that cooperates with a single guide rail is shown, the reverse arrangement is also possible. Electrical connector (14) preferably includes an insert (22) inside socket (23) that is shaped to receive the lower end of connector body (16) and that houses pin terminals (55).

The operation of the CPA plug (12) is as follows. Electrical connector (10) is inserted part way into socket (23) of the mating electrical connector (14), with the CPA plug (12) being in the pre-staged position, until the projecting lock ridges (38) engage the face of the mating electrical connector as best shown in FIGS. 2, 3 and 4. CPA plug (12) is then simply pushed down with the top surfaces (44) of lower windows (45) pushing the lock nibs (42) and consequently the projecting lock ridges (38) of connector body (16) into socket (23). Pushing lock ridges (38) into socket (22) rotates the lock arms (36) so that the lock ridges (38) move inwardly toward each other and the lock nibs (42) move outwardly away from each other and out of the lower bottomless windows (45) of CPA legs (32) as best shown in FIG. 6. Bottom surfaces (48) of CPA legs (32) now engage push ledges (40) which are a part of connector body (16) so that the CPA plug (12) continues pushing connector shroud (20) into socket (23). When electrical connector (10) is fully and properly mated to electrical connector (14), the projecting lock ridges (38) engage in an annular slot (57) in socket (23) as best shown in FIGS. 7 and 8. This allows lock arms (36) to rotate back to their original position so that the lock nibs (42) move inward toward each other and into upper windows (47) locking the CPA plug (12) in the final locked position shown in FIGS. 7 and 8. Thus electrical connector (10) is connected to the mating electrical connector (14) in one continuous movement simply by pushing the CPA plug (12) down until the CPA plug (12) locks in place in the final locked position. This not only simplifies mating of the electrical connectors (10) and (14) but also provides reliable mating in a blind assembly situation.

It should be noted that cover (28) preferably includes four triangular protrusions (66) that enter the triangular corner openings (49) in the operator pad (30) of CPA plug (12) when it is pushed down to the final locked position shown in FIGS. 7 and 8. This adds a visual sign that the electrical connectors (10) and (12) are properly mated. The visible sign may be enhanced by using contrasting colors for the CPA plug (12) and the cover (28).

To un-mate the connection, the CPA plug (12) is pulled up to override the CPA plug retention lock of the lock nibs (42) engaging in upper windows (47) by the angled bottom surfaces (46) of the upper windows (47) camming the lock nibs (42) outwardly out of upper windows (47). The CPA plug (12) then pulls upwardly away from connector body (16) and cover (28) until the four ledges (43) at the bottom of skirt (31) engage the underside of cover (28). Continued pulling of the CPA plug (12) upwardly now pulls the cover (28) and the shroud (20) of connector body (16) that is attached to the cover (28) upwardly out of socket (23) initially camming lock ridges (38) inwardly out of annular slot (57) as the shroud (20) is being pulled out of socket (23).

Figure 9:
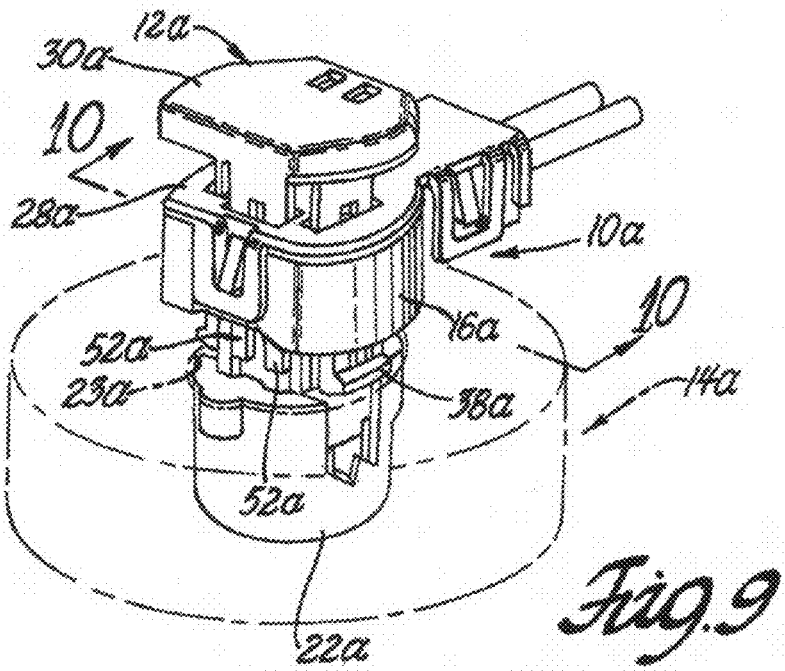
FIG. 9 is a perspective view of a second embodiment of the invention showing and electrical connector in the process of being connected.
Figure 10:
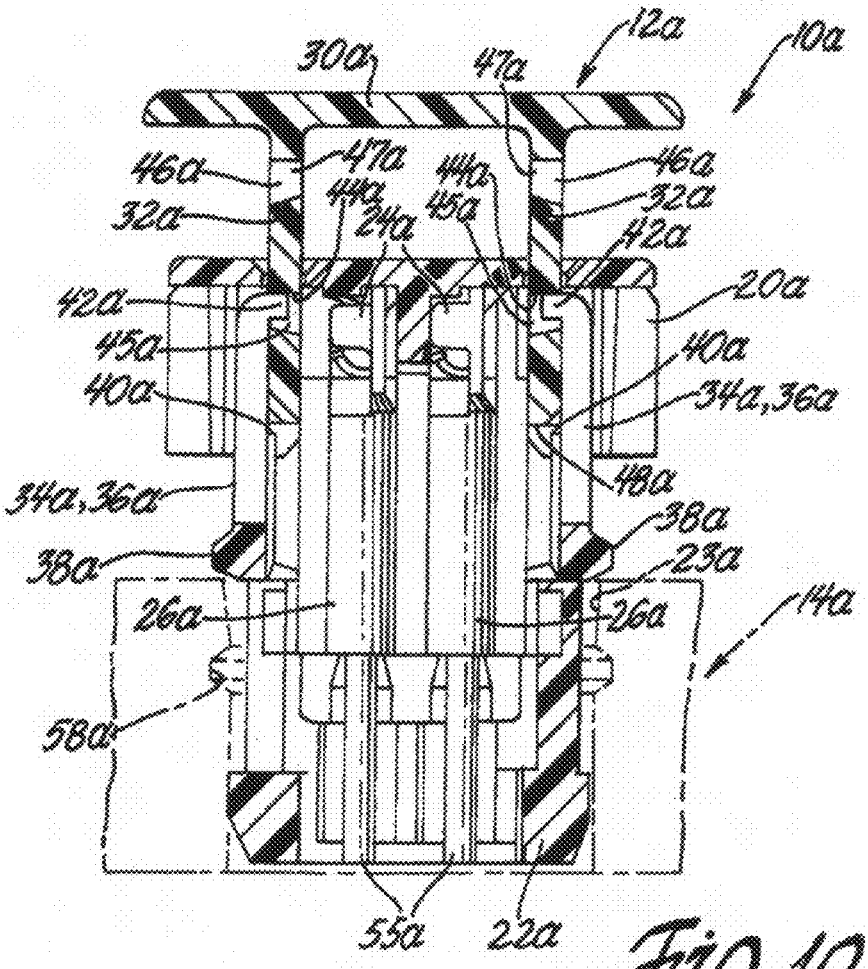
FIG. 10 is a sectional view of the second embodiment shown in FIG. 11.

Referring now to FIGS. 9 and 10 a second embodiment of the invention is illustrated as an electrical connector (10*a*) that has a CPA plug (12*a*) (connector position assurance plug) for assuring that the electrical connector (10*a*) is properly connected to a mating electrical connector (14*a*). Electrical connector (10*a*) comprises a right-angled connector body (16*a*) having a plurality of longitudinal channels that open into an axial shroud (20*a*) that plugs part way into a socket (23*a*) of the mating connector (14*a*) in the axial direction. A plurality of right angled terminals (24*a*) are disposed in the plurality of longitudinal channels respectively with their respective socket contacts (26*a*) disposed in the axial shroud (20*a*). A cover (28*a*) is attached to the connector body so that it overlies the connector body (16*a*) covering the plurality of longitudinal channels and closing the axial shroud (20*a*) at one end.

The CPA plug (12*a*) is attached to the cover (28*a*) for movement between an initial prestaged position (shown in FIG. 9) and a final locked position like that shown in FIGS. 7 and 8 assuring that the electrical connector (10*a*) is properly connected to the mating electrical connector (14*a*) when the electrical connectors (10*a*) and (14*a*) are mated.

The CPA plug (12*a*) has an operator pad (30*a*) outwardly of the cover and a plurality of spaced legs (32*a*) that project into the axial shroud (20*a*) via slots that extend through cover (28*a*).

The axial shroud (20*a*) has a plurality of lock mechanisms (34*a*) for holding the CPA plug (12*a*) in the initial prestaged position or in the final locked position. As best shown in FIG. 10, each lock mechanism (34*a*) comprises a pivotal lock arm (36*a*) that is pivotally connected to the axial shroud (20*a*) by a resilient portion. The pivotal arm (36*a*) has a lower outwardly projecting lock ridge (38*a*) for locking the electrical connector (10*a*) to the mating electrical connector (14*a*), a medial inwardly projecting push ledge (40*a*) for mating the electrical connectors (10*a*) and (14*a*), and an upper inwardly projecting lock nib (42*a*) that is engageable with one of the plurality of legs (32*a*) of the CPA plug for holding the CPA in either its initial or its final position.

Each leg (32*a*) of the CPA plug (12*a*) has a first portion (44*a*) engaged by the lock nib (42) of each lock mechanism (34*a*) to hold the CPA plug (12*a*) in the prestaged position as best shown in FIG. 10. The first portion (44*a*) engaged by the lock nib (42) of each lock mechanism (38*a*) to hold the CPA plug in the prestaged position is illustrated as a lower window (45*a*) in leg (32*a*) while the lock nib (42*a*) is illustrated by a single lock nib.

Each leg (32*a*) of the CPA plug (12*a*) also has a third portion (46*a*) engaged by the lock nib (42*a*) of the one lock mechanism to hold the CPA plug in the final locked position when the electrical connector is properly connected to the mating electrical connector (14*a*) as shown in FIGS. 7 and 8. The third portion (46*a*) engaged by the lock nib (42*a*) of the one lock mechanism to hold the CPA plug in the final locked position when the electrical connector (10*a*) is properly connected to the mating electrical connector (14*a*) is illustrated as an upper window (47*a*) in leg (32*a*).

Each leg (32*a*) of the CPA plug (12*a*) also has a third portion (48*a*) that engages the push ledge (40*a*) for pushing the electrical connector (10*a*) into locked engagement with the mating electrical connector (14*a*). The third portion (48*a*) that engages the push ledge (40*a*) for pushing the electrical connector into locked engagement with the mating electrical connector is illustrated as the bottom surface of leg (32*a*) as best shown in FIG. 10.

Electrical connector (10*a*) may also include a filter (not shown) isolating terminal contacts (26*a*) from each other inside shroud (20*a*). CPA plug (12*a*) preferably includes a depending guide (52*a*) that extends through a slot in cover (28*a*) and into shroud (20*a*) where it engages an internal guide rail (not shown) of shroud (20*a*) to guide CPA plug (12*a*) when it is pushed to the final locked position.

While a bifurcated guide (52*a*) that cooperates with a single guide rail is shown, the reverse arrangement is also possible. Electrical connector (14*a*) preferably includes an insert (22*a*) inside socket (23*a*), that houses pin terminals (55*a*).

The operation of the CPA plug (12*a*) is as follows. Electrical connector (10*a*) is inserted part way into socket (23*a*) of the mating electrical connector (14) with the CPA plug (12*a*) being in the prestaged position until the projecting lock ridges (38*a*) engage the face of the mating electrical connector as shown in FIG. 9. CPA plug (12*a*) is then simply pushed down with the top surfaces (44*a*) of lower windows (45*a*) pushing the lock nibs (42*a*) and consequently the projecting lock ridges (38*a*) of connector body (16*a*) into socket (23*a*). Pushing lock ridges (38*a*) into socket (22*a*) rotates the lock arms (36*a*) so that the lock ridges (38*a*) move inwardly toward each other and the lock nibs (42*a*) move outwardly away from each other and out of the lower windows (45*a*) of CPA legs (32*a*). Bottom surfaces (48*a*) of CPA legs (32*a*) now engage push ledges (40*a*) which are a part of connector body (16*a*) so that the CPA plug (12*a*) continues pushing connector shroud (20*a*) into socket (23*a*). When electrical connector (10*a*) is fully and properly mated to electrical connector (14*a*), the projecting lock ridges (38*a*) engage in an annular slot (58*a*) in socket (22*a*) as best shown in FIGS. 7 and 8 in connection with the first embodiment. This allows lock arms (36*a*) to rotate back to their original position so that the lock nibs (42*a*) move inward toward each other and into upper windows (47*a*) locking the CPA plug (12*a*) in the final locked position like the first embodiment shown in FIGS. 7 and 8. Thus electrical connector (10*a*) is connected to the mating electrical connector (14*a*) in one continuous movement simply by pushing the CPA plug (12*a*) down until the CPA plug (12*a*) locks in place in the final locked position. This not only simplifies mating of the electrical connectors (10*a*) and (14*a*) but also provides reliable mating in a blind assembly situation.

To un-mate the connection, the CPA plug (12*a*) is pulled up to override the CPA plug retention lock of the lock nibs (42*a*) engaging in upper windows (47*a*) by the angled bottom surfaces (46*a*) of the upper windows (47*a*) camming the lock nibs (42*a*) outwardly out of upper windows (47*a*). The CPA plug (12*a*) then pulls upwardly away from connector body (16*a*) and cover (26*a*) until lock nibs (42*a*) engage in lower windows (45*a*). In this regard, the contacting surfaces of the lock nibs (42*a*) and the lower windows (45*a*) are preferably both back angled, for instance about 10 degrees. Continued pulling of the CPA plug (12*a*) upwardly now pulls the shroud (20*a*) of connector body (16*a*) upwardly out of socket (23*a*) initially camming lock ridges (38*a*) inwardly out of annular slot (58*a*) as the shroud (20*a*) is being pulled out of socket (23*a*).

Referring now to FIGS. 11 to 16, an electrical connector (110) illustrating a third embodiment of the invention has a CPA plug (112) (connector position assurance plug) for assuring that the electrical connector (110) is properly connected to a mating electrical connector (114). Electrical connector (110) comprises a right-angled connector body (116) having a plurality of longitudinal channels that open into an axial shroud (120) that plugs part way into a socket (122) of the mating connector (110) in the axial direction. A plurality of right angled terminals (124) are disposed in the plurality of longitudinal channels respectively with their respective socket contacts (126) disposed in the axial shroud (120). A cover (128) is attached to the connector body so that it overlies the connector body (116) covering the plurality of longitudinal channels and closing the axial shroud (120) at one end.

The CPA plug (112) is attached to the cover (128) for movement between an initial prestaged position (shown in FIGS. 11, 12, 13 and 14) and a final locked position (not shown but explained in connection with FIG. 17) assuring that the electrical connector (110) is properly connected to the mating electrical connector (114) when the electrical connectors (110) and (114) are mated.

The CPA plug (112) has an operator pad (130) outwardly of the cover and a plurality of T-shaped spaced legs (132) that project into the axial shroud (120) via slots that extend through cover (128).

Figure 12:
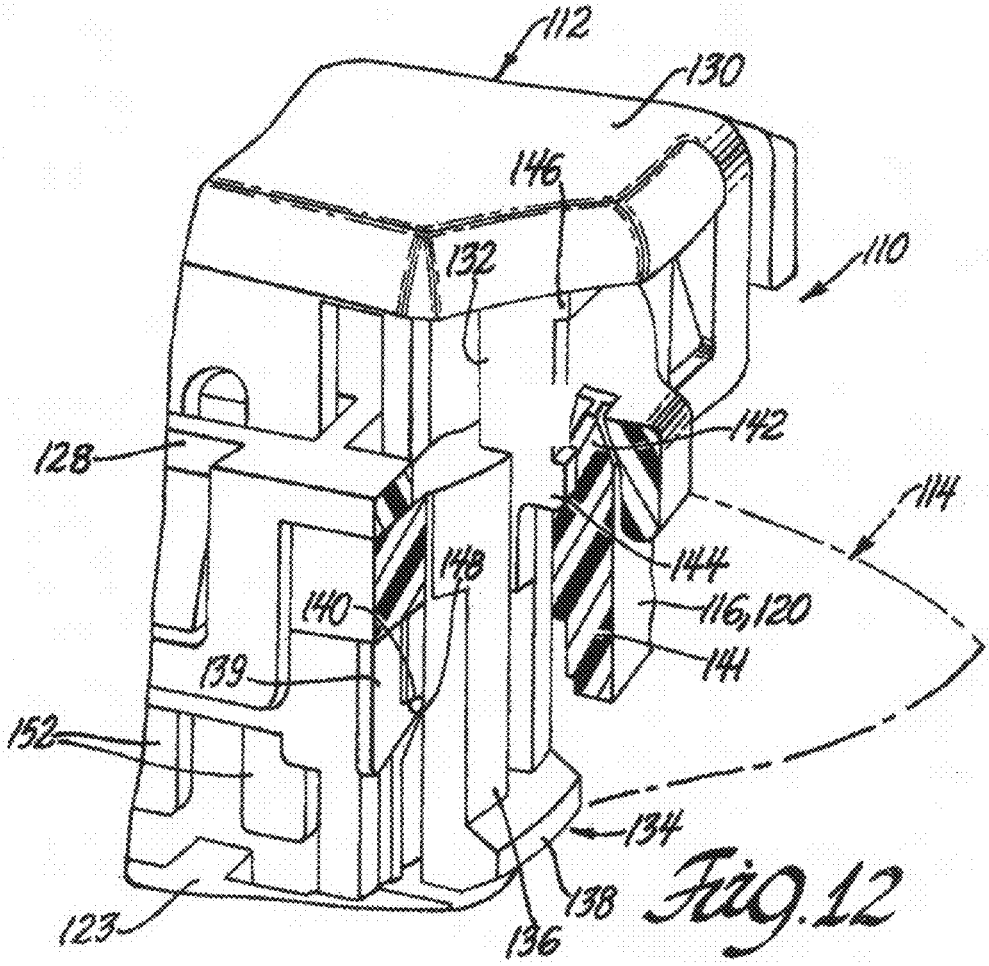
FIG. 12 is a sectioned perspective view of the third embodiment.
Figure 13:
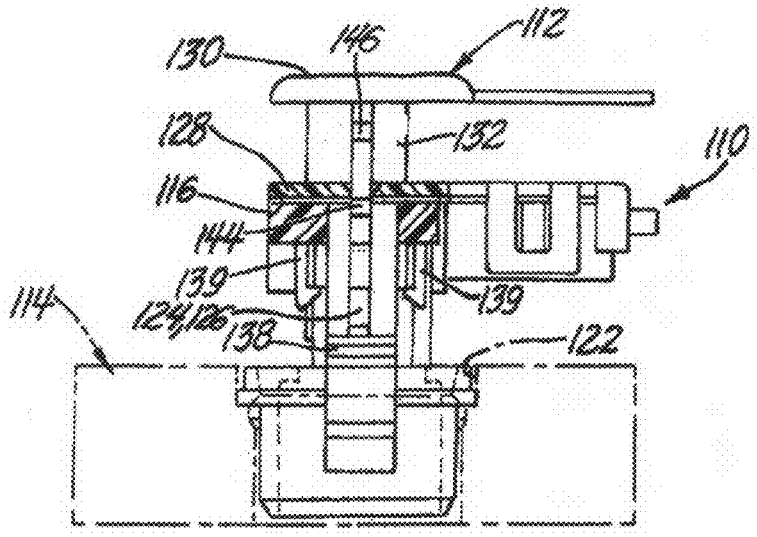
FIG. 13 is a sectioned side view of the third embodiment.

The axial shroud (120) has a plurality of lock mechanisms (134) for holding the CPA plug (112) in the initial prestaged position or in the final locked position. As best shown in FIG. 12, each lock mechanism (134) comprises a pivotal lock arm (136) that is pivotally connected to the axial shroud (120) by a resilient portion. The pivotal arm (136) has a lower outwardly projecting lock ridge (138) for locking the electrical connector (110) to the mating electrical connector (114). Each lock mechanism (134) also includes two flexible retention arms (139) carried by the axial shroud (120) in a coplanar relationship. The flexible retention arms (139) have inwardly projecting push ledges (140) for holding the CPA plug up in its initial prestaged position as best shown in FIGS. 12 and 13 and for use in mating the electrical connectors (110) and (114). In addition, each lock mechanism (134) includes an outward strap (141) of the connector body shroud (120) that has an upper inwardly projecting lock nib (142) that is engageable with one of the plurality of legs (132) of the CPA plug (112) for holding the CPA plug down in either its initial or its final position, the initial position being shown in FIG. 12.

Each leg (132) of the CPA plug (112) has a first side rib (144) engaged by the lock nib (142) of one lock mechanism to hold the CPA plug down in the prestaged position as best shown in FIG. 12. The first side rib (144) engaged by the lock nib (142) of one lock mechanism to hold the CPA plug in the prestaged position is illustrated as a lower side rib (144) projecting outwardly of leg (132). The CPA plug (112) is held up in the prestaged position by the flexible retention arms (139). In other words, the CPA plug (112) is trapped in the prestaged position by the lock nib (142) engaging the lower side rib (144) and the flexible retention arms (139) engaging the bottom surfaces (148) of the T-shaped legs (132).

Each T-shaped leg (132) of the CPA plug (112) also has a second side rib (146) engaged by the lock nib (142) of the one lock mechanism to hold the CPA plug (112) in the final locked position when the electrical connector is properly connected to the mating electrical connector (114). The final locked position is not shown. However, the relationship between the second side rib (146) and the lock nib (142) is shown in connection with FIG. 17 which will be discussed below in connection with un-mating the connection. The second side rib (146) engaged by the lock nib (142) of the one lock mechanism to hold the CPA plug in the final locked position when the electrical connector (110) is properly connected to the mating electrical connector (114) is illustrated as an upper side rib of the T-shaped leg (132).

Figure 14:
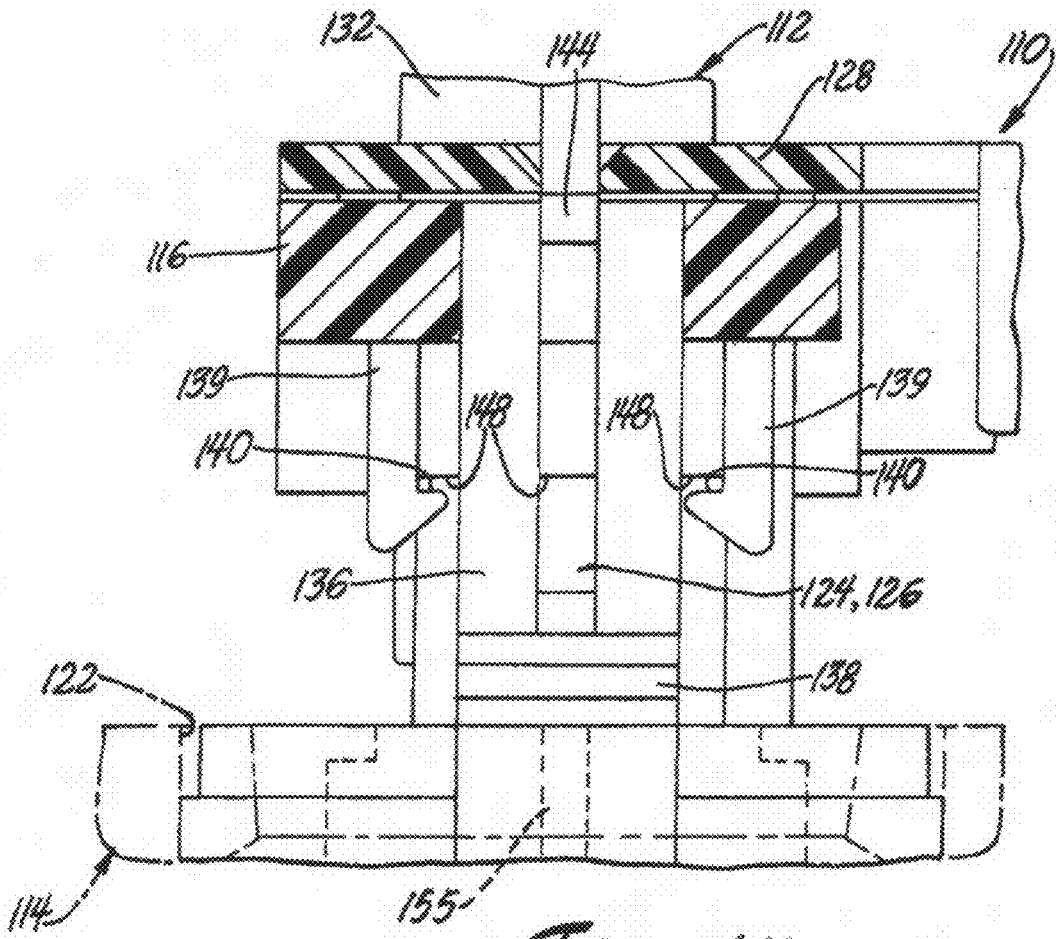
FIG. 14 is an enlarged sectioned side view of the third embodiment.
Figure 15:
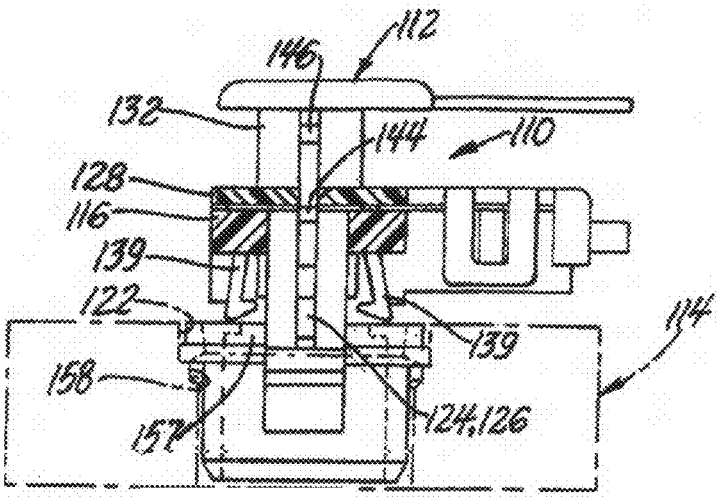
FIG. 15 is a sectioned side view of the third embodiment in a later stage of assembly.

Each T-shaped leg (132) of the CPA plug (112) also has a third portion (148) that engages the push ledges (140) of the flexible retention arms (139) for pushing the electrical connector (110) into locked engagement with the mating electrical connector (114). The third portion (148) that engages the push ledges (140) for pushing the electrical connector (110) into locked engagement with the mating electrical connector (114) is the bottom surface of the T-shaped leg (132) which also holds the CPA plug (112) up in the pre-staged position as best shown in FIGS. 12, 13 and 14. FIG. 14 shows a slight spacing between bottom surfaces (148) and ledges (140) for clarity.

CPA plug (112) also preferably includes a depending guide (152) that extends through a slot in cover (128) and into shroud (120) where it engages an internal guide rail (not shown) of shroud (120) to guide CPA plug (112) when it is pushed to the final locked position. While a bifurcated guide (152) that cooperates with a single guide rail is shown, the reverse arrangement is also possible.

Electrical connector (114) includes an insert (123) that provides initiator portions (157) inside socket (122) spreading the flexible retention arms (139) outwardly. Insert (123) houses terminals (155) and is only partially illustrated in some views.

Figure 16:
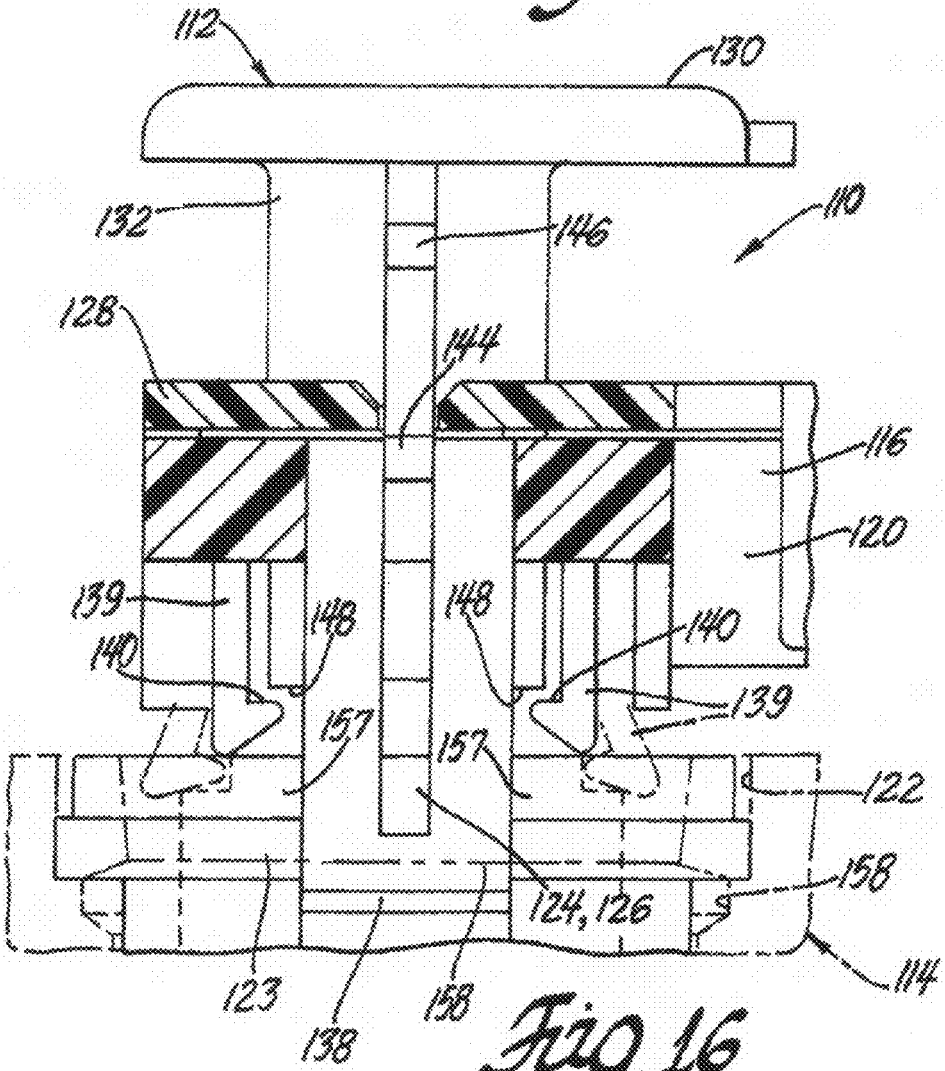
FIG. 16 is an enlarged sectioned side view of the third embodiment in the later stage of assembly.

The operation of the CPA plug (112) is as follows. Electrical connector (110) is inserted part way into socket (122) of the mating electrical connector (114) with the CPA plug (112) being in the prestaged position until the projecting lock ridges (138) engage the face of the mating electrical connector as shown in FIGS. 11-14. CPA plug (112) is then simply pushed down with the bottom surfaces (148) of the T-shaped legs (132) pushing the flexible retention arms (139) and consequently the projecting lock ridges (138) of connector body (116) down into socket (122). Pushing lock ridges (138) down into socket (122) rotates the lock arms (136) so that the lock ridges (138) move inwardly toward each other storing energy in lock arms (136). As the CPA plug (112) and the connector body (116) are pushed into socket (122), the flexible retention arms (139) engage initiator portions (157) of socket insert (123) spreading the flexible retention arms (139) apart as best shown in FIG. 16. When the outwardly projecting lock ridges (138) reach an annular retention slot (158) in socket (122), pivotal lock arms (136) spread apart engaging the outwardly projecting lock ridges (138) in the annular retention slot (158) to lock the electrical connectors (110) and (114) together in a fully mated connection. At this time, the flexible retention arms (139) are deflected outwardly enough so that push surfaces (140) disengage from the bottom surfaces (148) of CPA legs (132) so that the CPA plug (112) moves relative to the connector shroud (120) and continues being pushed down into socket (122) until the lock nib (142) engages an angled top surface of the upper side rib (146) to hold the CPA plug (112) in the final locked position (not shown). However, the final locked position of the CPA plug (112) with respect to connector shroud (120) is shown at A in FIG. 17 as explained below. Thus electrical connector (110) is connected to the mating electrical connector (114) in one continuous movement simply by pushing the CPA plug (112) down until the CPA plug (112) locks in place in the final locked position. This not only simplifies mating of the electrical connectors (110) and (114) but also provides reliable mating in a blind assembly situation.

Figure 11:
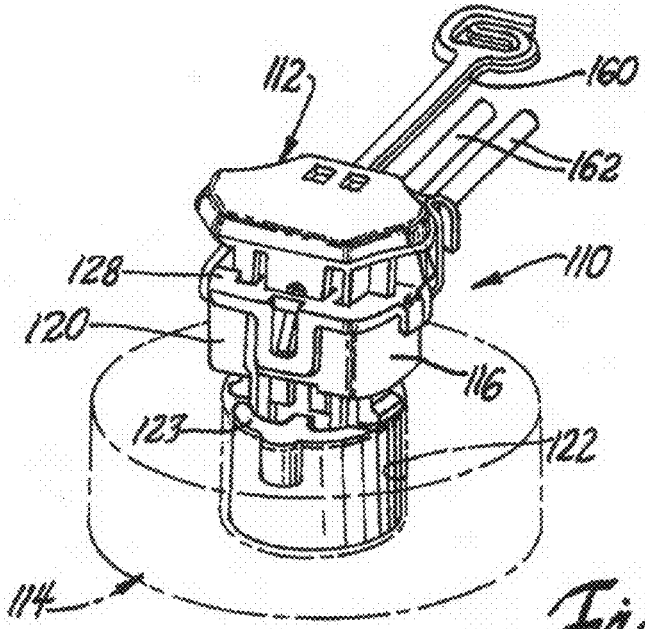
FIG. 11 is a perspective view of a third embodiment of the invention showing the CPA plug in a prestaged position.
Figure 17:
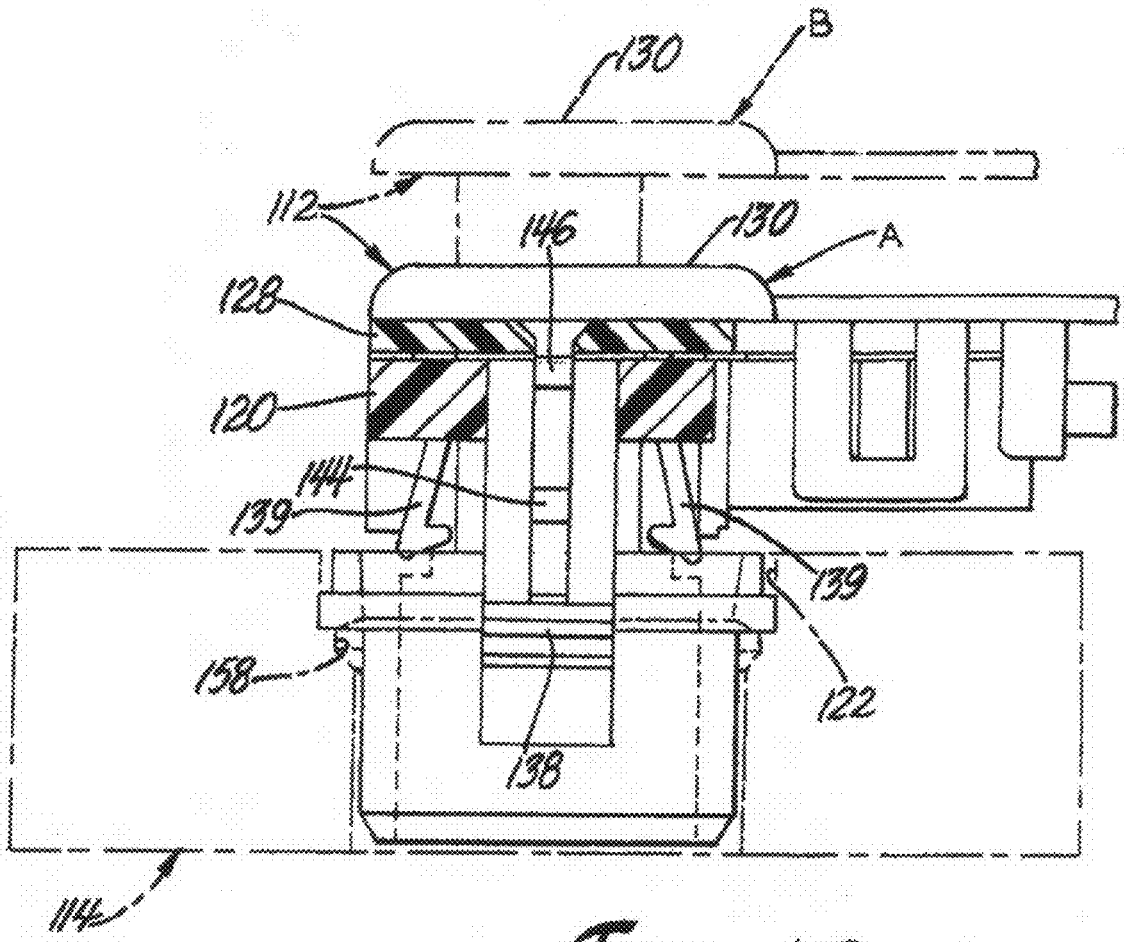
FIG. 17 is a sectioned side view of the third embodiment in an unmating stage.

To un-mate the connection, the CPA plug (112) is pulled up to override the CPA plug retention lock of the lock nibs (142) engaging the upper side ribs (146) by the angled top surfaces of the upper side ribs (146) camming the lock nibs (142) outwardly out of engagement with the upper side ribs (146). The CPA plug (112) initially then pulls upwardly away from connector body (116) until lock nibs (142) engage the lower side ribs (144). This is illustrated in FIG. 17 as the CPA plug (112) moving from position A to position B relative to connector shroud (120). Continued pulling of the CPA plug (112) upwardly now pulls the shroud (120) of connector body (116) upwardly out of socket (122) initially camming lock ridges (138) inwardly out of annular slot (158) as the shroud (120) is being pulled out of socket (122). As the shroud (120) is being pulled out of socket (122), the flexible retention arms (139) disengage from the initiator portions (157) and flex inwardly to engage the bottom surfaces (148) of the T-shaped leg (132) to hold the CPA plug (112) up in the prestaged position shown at B in FIG. 17. CPA plug (112) may include an optional tether strap (160) for attaching the CPA plug (112) to conductor wires (162) as indicated in FIG. 11.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

I claim:

1. An electrical connector having a CPA plug (connector position assurance plug) for assuring that the electrical connector is properly connected to a mating electrical connector comprising:

a right-angled connector body having a plurality of longitudinal channels that open into an axial shroud that plugs into a socket of the mating connector in the axial direction, a plurality of right angled terminals that are disposed in the plurality of longitudinal channels respectively with their respective contacts disposed in the axial shroud, a cover that is attached to the connector body so that it overlies the plurality of longitudinal channels and the axial shroud, the CPA plug being attached to the cover for movement between a prestaged position and a final locked position assuring that the electrical connector is properly connected to the mating electrical connector, the CPA plug having an operator pad outwards of the cover and a plurality of spaced legs that project into the axial shroud via slots that extend through the cover, the axial shroud having a plurality of lock mechanisms, each lock mechanism comprising a pivotal lock arm that has a lower outwardly projecting lock ridge for locking the electrical connector to the mating electrical connector, a medial inwardly projecting push ledge for pushing the electrical connector into locked engagement with the mating electrical connector, and an upper inwardly projecting lock nib that is engagable with one of the plurality of legs of the CPA plug, each of the plurality of legs of the CPA plug having a first portion engaged by the lock nib of one lock mechanism to hold the CPA plug in the prestaged position, each of the plurality of legs of the CPA plug having a second portion engaged by the lock nib of the one lock mechanism to hold the CPA plug in the final locked position when the electrical connector is properly connected to a mating electrical connector, and each of the plurality of legs of the CPA plug having a third portion that engages the push ledge for pushing the electrical connector into locked engagement with the mating electrical connector.

2. The electrical connector as defined in claim 1 wherein the first portion engaged by the lock nib of one lock mechanism to hold the CPA plug in the prestaged position is a lower window in each of the plurality of legs.

3. The electrical connector as defined in claim 1 wherein the second portion engaged by the lock nib of the one lock mechanism to hold the CPA plug in the final locked position when the electrical connector is properly connected to a mating electrical connector is an upper window in each of the plurality of legs.

4. The electrical connector as defined in claim 1 wherein the third portion that engages the push ledge for pushing the electrical connector into locked engagement with the mating electrical connector is a bottom surface of each of the plurality of legs.

5. The electrical connector as defined in claim 1 wherein the CPA plug has openings that receive projections of the cover when the CPA plug is in the final locked position indicating that the electrical connector is properly connected to the mating electrical connector.

6. The mating electrical connector as defined in claim 1 wherein the CPA plug has a skirt outwardly of the cover and the axial shroud of the right-angled connector body.

7. The electrical connector has defined in claim 6 wherein the skirt has slots that cooperate with guide ribs of the axial shroud to guide the CPA plug between the pre-staged position and the final locked position.

8. The electrical connector as defined in claim 6 wherein the skirt has ledges that engage a bottom surface of the cover to assist in disconnecting the electrical connector from the mating electrical connector.

9. The electrical connector as defined in claim 6 wherein the CPA plug has openings that receive projections of the cover when the CPA plug is in the final locked position indicating that the electrical connector is properly connected to the mating electrical connector.

10. An electrical connector having a CPA plug (connector position assurance plug) for assuring that the electrical connector is properly connected to a mating electrical connector comprising:

a right-angled connector body having a plurality of longitudinal channels that open into an axial shroud that plugs into a socket of the mating connector in the axial direction, a plurality of right angled terminals that are disposed in the plurality of longitudinal channels respectively with their respective contacts disposed in the axial shroud, a cover that is attached to the connector body so that it overlies the plurality of longitudinal channels and the axial shroud, the CPA plug being attached to the cover for movement between a prestaged position and a final locked position assuring that the electrical connector is properly connected to the mating electrical connector, the CPA plug having an operator pad outwards of the cover and a plurality of spaced legs that project into the axial shroud via slots that extend through the cover, the axial shroud having a plurality of lock mechanisms, each lock mechanism comprising a pivotal lock arm that has a lower outwardly projecting lock ridge for locking the electrical connector to the mating electrical connector, each lock mechanism further comprising at least one flexible retention arm having an inwardly projecting push ledge for pushing the electrical connector into locked engagement with the mating electrical connector, and each lock mechanism further comprising a strap having an upper inwardly projecting lock nib that is engagable with one of the plurality of legs of the CPA plug, each of the plurality of legs of the CPA plug having a first portion engaged by the lock nib of one lock mechanism to hold the CPA plug in the prestaged position, each of the plurality of legs of the CPA plug having a second portion engaged by the lock nib of the one lock mechanism to hold the CPA plug in the final locked position when the electrical connector is properly connected to a mating electrical connector, and each of the plurality of legs of the CPA plug having a third portion that engages the push ledge for pushing the electrical connector into locked engagement with the mating electrical connector.

11. The electrical connector as defined in claim 10 wherein the first portion engaged by the lock nib of one lock mechanism to hold the CPA plug in the prestaged position is a lower side rib on each of the plurality of legs.

12. The electrical connector as defined in claim 10 wherein the second portion engaged by the lock nib of the one lock mechanism to hold the CPA plug in the final locked position when the electrical connector is properly connected to a mating electrical connector is an upper side rib on each of the plurality of legs.

13. The electrical connector as defined in claim 10 wherein the third portion that engages the push ledge for pushing the electrical connector into locked engagement with the mating electrical connector is a bottom surface of each of the plurality of legs.

* * * * *